US012698919B2

(12) United States Patent
Gokhale

(10) Patent No.: US 12,698,919 B2
(45) Date of Patent: Aug. 4, 2026

(54) COMPRESSOR MODULATION IN NON-COMMUNICATING MODE

(71) Applicant: Lennox Industries Inc., Richardson, TX (US)

(72) Inventor: Umesh Gokhale, Coppell, TX (US)

(73) Assignee: Lennox Industries Inc., Richardson, TX (US)

( * ) Notice: Subject to any disclaimer, the term of this patent is extended or adjusted under 35 U.S.C. 154(b) by 356 days.

(21) Appl. No.: 18/399,901

(22) Filed: Dec. 29, 2023

(65) Prior Publication Data

US 2025/0216116 A1 Jul. 3, 2025

(51) Int. Cl.

| | |
|---|---|
| ***F24F 11/86*** | (2018.01) |
| ***F24F 11/61*** | (2018.01) |
| ***F24F 11/64*** | (2018.01) |
| *F24F 140/12* | (2018.01) |

(52) U.S. Cl.

CPC ..... *F24F 11/86* (2018.01); *F24F 11/61* (2018.01); *F24F 11/64* (2018.01); *F24F 2140/12* (2018.01)

(58) Field of Classification Search

CPC .. F24F 11/86; F24F 11/64; F24F 11/61; F24F 2140/12

See application file for complete search history.

(56) References Cited

U.S. PATENT DOCUMENTS

| | | | | |
|---|---|---|---|---|
| 5,475,986 | A * | 12/1995 | Bahel | F24F 11/84 62/211 |
| 8,011,199 | B1 * | 9/2011 | Chen | F24F 11/77 62/157 |
| 8,601,828 | B2 * | 12/2013 | Moseley | F04B 49/10 62/229 |
| 9,625,345 | B2 * | 4/2017 | Berg | F25B 13/00 |
| 9,683,768 | B2 * | 6/2017 | Takayama | F25B 13/00 |
| 10,436,490 | B2 * | 10/2019 | Pham | F24F 11/83 |
| 10,828,963 | B2 * | 11/2020 | Vehr | F25B 5/02 |
| 10,895,413 | B2 | 1/2021 | Gokhale et al. | |
| 11,378,317 | B2 * | 7/2022 | Gokhale | F25B 49/02 |
| 2015/0059380 | A1 * | 3/2015 | Takayama | F25B 49/022 62/222 |
| 2018/0031266 | A1 * | 2/2018 | Atchison | F24F 11/30 |

* cited by examiner

*Primary Examiner* — Ramsey Refai

(74) *Attorney, Agent, or Firm* — Baker Botts L.L.P.

(57) ABSTRACT

An HVAC system compressor controller receives a signal, retrieves a first pressure set point and a second pressure set point, and operates a compressor at a speed determined based on at least one of the first pressure set point or the second pressure set point. The compressor speed is determined by the first pressure set point when the signal is a first command, and by the second pressure set point when the signal is a second command. The compressor controller changes the first pressure set point to a default set point when at least one condition is met, or by an amount that is determined using at least one of a first runtime, a second runtime, the total runtime, and an average measured pressure when the at least one condition is not met. The changed first pressure set point is then stored in the memory.

20 Claims, 4 Drawing Sheets

COMPRESSOR MODULATION IN NON-COMMUNICATING MODE

TECHNICAL FIELD

The present disclosure generally relates to heating, ventilation, and air conditioning (HVAC) system control and, more specifically, to compressor modulation in non-communicating mode.

BACKGROUND

Heating ventilation and air conditioning (HVAC) systems often include a compressor that may be operated at only one speed. Since the compressor only operates at one speed, it is not able to decrease energy use when the environmental conditions are less extreme. Alternatively, when the environmental conditions are extreme, the compressor may be unable to provide sufficient cooling or heating. The use of a compressor that only operates at one speed decreases the efficiency of the HVAC system and/or requires a larger system to be used to cool or heat a particular facility, as the HVAC system must be designed to provide sufficient cooling or heating at predicted extreme environmental conditions.

SUMMARY OF THE DISCLOSURE

In heating, ventilation, and air conditioning (HVAC) systems, variable-speed compressors provide many advantages over single-speed compressors. These may include increased efficiency compared to single-speed compressors. However, efficiencies may be better achieved when the compressor speed is adjusted based on the load in the space that is being heated or cooled. When an HVAC system that utilizes a variable speed compressor replaces an older system with a single speed compressor, the pre-existing controllers, such as a thermostat, may not be able to provide this information, at least in enough detail to efficiently operate the variable speed compressor.

To overcome this in certain embodiments, a pressure measurement is taken by a sensor in a suction line; this measurement may be a suction pressure when the HVAC system is in a cooling mode or a liquid pressure when the system is in a heating mode. This measured pressure may serve as a proxy for the current load in the space being cooled or heated. The compressor's speed may then be adjusted to maintain the measured pressure at or about a pressure set point. By adjusting the compressor's speed in this manner, as the load changes, the compressor's speed is increased or decreased, providing the heating or cooling needed for a particular load or environment. However, this solution is not always efficient. Depending on the pressure set point, the compressor may run longer than desired or shorter than what is efficient and/or healthy for the HVAC system. Certain embodiments adjust the pressure set point to obtain a more efficient pressure set point for the real-world environment that the compressor and/or HVAC system is deployed in while avoiding operating for periods that are less than or greater than desirable periods.

According to certain embodiments, the system comprises an indoor unit, an outdoor unit, a pressure sensor, and an HVAC controller. The indoor unit includes an indoor heat-exchange coil, an indoor circulation fan arranged to circulate air through the indoor heat-exchange coil, and a metering device fluidly coupled to the indoor heat-exchange coil. The outdoor unit includes an outdoor heat-exchange coil, an outdoor circulation fan arranged to circulate air through the outdoor heat-exchange coil, a compressor fluidly coupled to the outdoor heat-exchange coil and fluidly coupled to the indoor heat-exchange coil, and a compressor controller electrically connected to the compressor. The compressor controller comprises at least one processor and at least one memory associated with the compressor controller. The system also includes a pressure sensor that is electrically coupled to the compressor controller and is disposed in a suction line between the compressor and the indoor heat-exchange coil. The HVAC controller is also electrically connected to the compressor controller and configured to transmit a signal to the compressor controller.

According to certain embodiments, the compressor controller is configured to receive a signal or demand call and then determine a compressor off time during the system's operation. The compressor controller then retrieves a first pressure set point and a second pressure set point from the memory. The first pressure set point is changed to a default set point when the compressor's off time is greater than a first predetermined time. The compressor controller then operates the compressor at a compressor speed that is determined based on at least one of the first pressure set point or the second pressure set point while the signal is received. During operation, the compressor speed is determined by the first pressure set point when the signal is a first command, and the compressor speed is determined by the second pressure set point when the signal is a second command.

The compressor controller determines a first runtime, a second runtime, and a total runtime when the signal changes, wherein the first runtime is the length of time the signal is the first command, the second runtime is the length of time the signal is a second command, and the total runtime is a sum of the first runtime and the second runtime. The compressor controller then changes the first pressure set point to a default set point when at least one condition is met or changes the first pressure set point by an amount that is determined using at least one of the first runtime, the second runtime, the total runtime, and an average measured pressure when the at least one condition is not met. The changed first pressure set point is then stored in the memory.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings and detailed description, wherein like reference numerals represent like parts.

DETAILED DESCRIPTION

Figure 1:
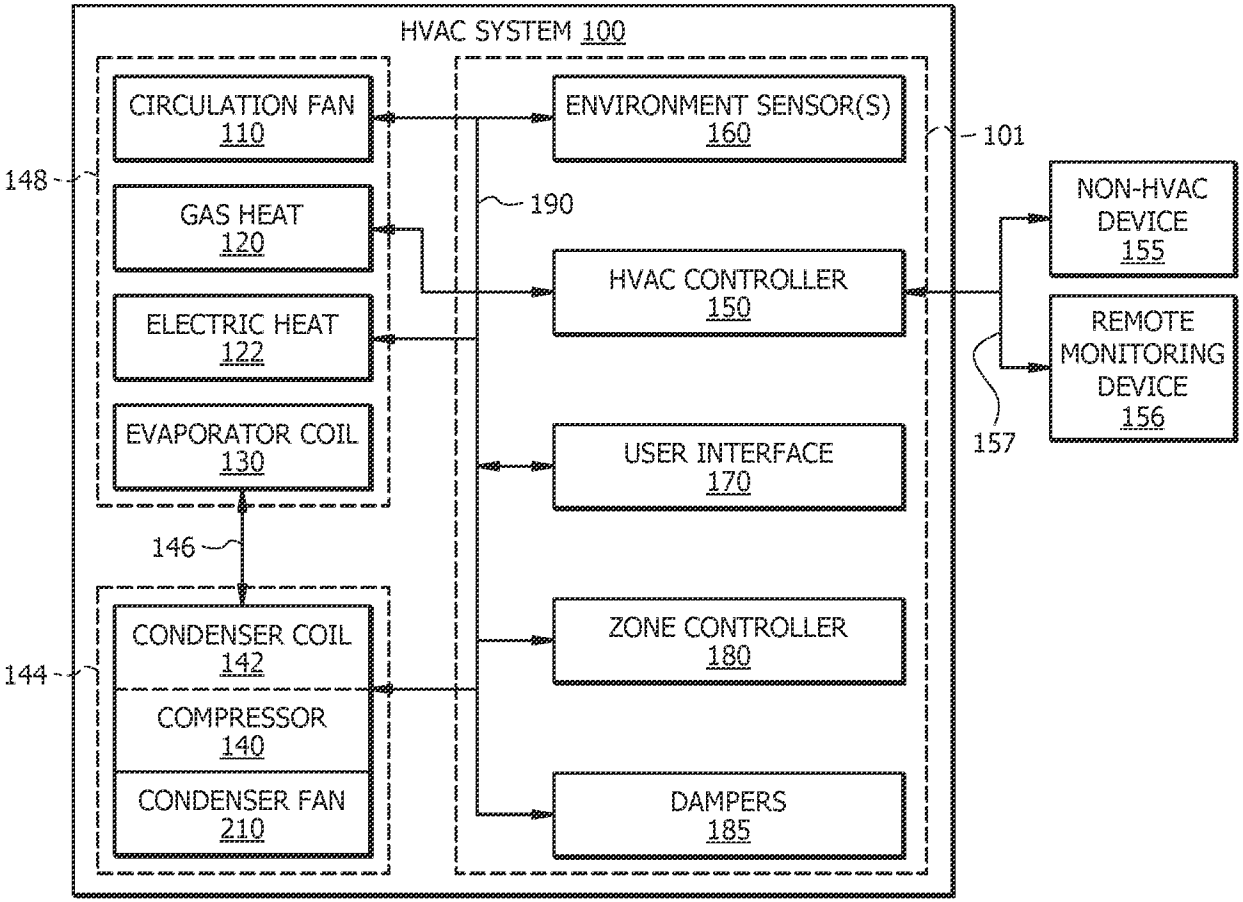
FIG. 1 is a block diagram of an HVAC system.

Various embodiments will now be described more fully with reference to the accompanying drawings. The disclosure may, however, be embodied in many different forms and should not be construed as limited to the embodiments set forth herein.

HVAC systems are frequently utilized to adjust both the conditioned air's temperature and the conditioned air's relative humidity. The cooling capacity of an HVAC system is a combination of the HVAC system's sensible cooling capacity and latent cooling capacity. Sensible cooling capacity refers to the ability of the HVAC system to remove sensible heat from conditioned air. Latent cooling capacity refers to the ability of the HVAC system to remove latent heat from conditioned air. In a typical embodiment, sensible cooling capacity and latent cooling capacity vary with environmental conditions. Sensible heat refers to heat that, when added to or removed from the conditioned air, results in a temperature change in the conditioned air. Latent heat refers to heat that, when added to or removed from the conditioned air, results in a phase change of, for example, water within the conditioned air. Sensible-to-total ratio ("S/T ratio") is a ratio of sensible heat to total heat. The lower the S/T ratio, the higher the latent cooling capacity of the HVAC system for given environmental conditions.

Sensible cooling load refers to an amount of heat that must be removed from the enclosed space to accomplish a desired temperature change of the air within the enclosed space. A temperature within the enclosed space reflects the sensible cooling load as read on a dry-bulb thermometer. Latent cooling load refers to an amount of heat that must be removed from the enclosed space to accomplish a desired change in humidity of the air within the enclosed space. A temperature within the enclosed space reflects the latent cooling load as read on a wet-bulb thermometer.

In situations where there is a high sensible cooling load, such as, for example, when the outside air temperature is significantly warmer than an inside-air temperature setpoint, the HVAC system will continue to operate in an effort to cool and dehumidify the conditioned air effectively. When there is a low sensible cooling load but high relative humidity, such as, for example, when the outside air temperature is relatively close to the inside air temperature setpoint, but the outside air is considerably more humid than the inside air, an HVAC system having a single speed compressor will often repeatedly cycle between an active state and a de-activated state to provide de-humidification air while not over-conditioning the air. At the same time, the HVAC system sets a particular setpoint temperature by a user or automatically based on a pre-defined schedule, based on a user's or other concerned entity's preferences. These preferences may result in the HVAC system operating longer than what is preferred or inefficiently. In such situations, a variable speed compressor allows the HVAC system to run more continuously at a lower speed, providing more effective de-humidification of air.

FIG. 1 illustrates an HVAC system 100. In various embodiments, the HVAC system 100 may be a networked or other type of HVAC system 100 that is configured to condition air via, for example, heating, cooling, humidifying, or dehumidifying air within an enclosed space 101. The HVAC system 100 may include a variable speed compressor 140 that is operated in accordance with the methods described below and shown in FIG. 3 and FIG. 4. In various embodiments, the enclosed space 101 is, for example, a house, an office building, a warehouse, or the like. Thus, the HVAC system 100 may be a residential system or a commercial system such as, for example, a rooftop system. The HVAC system 100, as illustrated in FIG. 1, includes various components; however, in other embodiments, the HVAC system 100 may include additional components that are not illustrated but may, in various embodiments, be included within HVAC systems.

The HVAC system 100 may include an indoor circulation fan 110 arranged to circulate air over an indoor heat-exchange coil 130, which, when the HVAC system 100 is operated as a cooling system, functions as an evaporator coil. The indoor circulation fan 110 may also circulate air over at least one of a gas heat component 120 and an electric heating component 122. The indoor circulation fan 110, the gas heat component 120, the electric heat component 122, as well as the heat-exchange coil 130 are collectively referred to as an "indoor unit" 148. In a typical embodiment, the indoor unit 148 may be located within, or in close proximity to, the enclosed space 101.

The HVAC system 100 may include at least one variable speed compressor 140 and an outdoor heat-exchange coil 142, which may function as a condenser or evaporator coil, depending on whether the HVAC system 100 is operating in a cooling or heating mode. An outdoor circulation fan 210 may also be included along with the outdoor heat-exchange coil 142 and variable speed compressor 140, which may make up and be referred to as an "outdoor unit" 144. In various embodiments, the outdoor unit 144 is, for example, a rooftop unit, a ground-level unit, or any other appropriate location. The variable speed compressor 140 and the associated outdoor heat-exchange coil 142 and/or other outdoor devices are connected to the indoor heat-exchange coil 130 by a refrigerant line 146. In various embodiments, the indoor circulation fan 110, sometimes referred to as a blower, is configured to operate at different capacities and/or variable motor speeds to circulate air through the HVAC system 100, whereby the circulated air is conditioned and supplied to the enclosed space 101.

The HVAC system 100 includes an HVAC controller 150 that is configured to control the operation of the various components of the HVAC system 100, such as, for example, the indoor circulation fan 110, at least one of the gas heat component 120 and the electric heat component 122, and the variable speed compressor 140 to regulate the environment of the enclosed space 101. In some embodiments, the HVAC system 100 may be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101. In various embodiments, the HVAC controller 150 may communicate an on/off signal to the variable speed compressor 140 via, for example, a 24 Volt alternating-current (VAC) signal.

In various embodiments, the HVAC controller 150 may be an integrated controller or a distributed controller that directs the operation of the HVAC system 100. In various embodiments, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In various embodiments, the HVAC controller 150 may also include a processor (not shown) and a memory (not shown) to direct operation of the HVAC system 100, including, for example, a speed of the variable speed compressor 140.

In some embodiments, the plurality of environment sensors 160 are associated with the HVAC controller 150 and optionally associated with a user interface 170. The plurality of environment sensors 160 provides environmental information within a zone or zones of the enclosed space 101, such as for example, temperature and humidity of the enclosed space 101 to the HVAC controller 150. The plurality of environment sensors 160 may also send the environmental information to a display of the user interface 170. In some embodiments, the user interface 170 provides additional functions such as for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to a user. The user interface 170 may also include a display, buttons, a microphone, a speaker, or other components to communicate with the user. Additionally, the user interface 170 may include a processor and memory configured to receive user-determined parameters such as, for example, relative humidity of the enclosed space 101 and calculate operational parameters of the HVAC system 100 as disclosed herein.

In a typical embodiment, the HVAC system 100 is configured to communicate with a plurality of devices, such as, for example, a monitoring device 156, a non-HVAC device, and the like. In a typical embodiment, the monitoring device 156 is not part of the HVAC system. For example, the monitoring device 156 is a server or computer of a third party, such as, for example, a manufacturer, a support entity, a service provider, and the like. In other embodiments, the monitoring device 156 is located at an office of, for example, the manufacturer, the support entity, the service provider, and the like.

In various embodiments, the non-HVAC device 155 may have a primary function not associated with the HVAC system 100. For example, the non-HVAC device 155 may include mobile computing devices (not shown) configured to interact with the HVAC system 100 and monitor and modify at least some of the operating parameters of the HVAC system 100. Mobile computing devices (not shown) may be, for example, a personal computer (e.g., desktop or laptop), a tablet computer, a mobile device (e.g., smartphone), and the like. In various embodiments, the non-HVAC device 155 includes at least one processor, memory, and a user interface, such as a display. One skilled in the art will also understand that the non-HVAC device 155 disclosed herein includes other components typically included in such devices, including, for example, a power supply, a communications interface, and the like.

The zone controller 180 is configured to manage the movement of conditioned air to designated zones of the enclosed space 101. Each designated zone includes at least one conditioning or demand unit, such as, for example, the gas heat component 120, and at least one user interface 170, such as, for example, the thermostat. The zone-controlled HVAC system 100 allows the user to control the temperature independently in the designated zones. In various embodiments, the zone controller 180 operates electronic dampers 185 to control airflow to the zones of the enclosed space 101.

In some embodiments, a data bus 190, which in the illustrated embodiment is a serial bus, couples various components of the HVAC system 100 together such that data is communicated between them. In a typical embodiment, the data bus 190 may include, for example, any combination of hardware, software embedded in a computer-readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), an HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PC-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cables and contacts may couple the HVAC controller 150 to the various components. In some embodiments, a wireless connection is employed to provide at least some of the connections between components of the HVAC system, such as, for example, a connection between the HVAC controller 150 and the indoor circulation fan 110 or the plurality of environment sensors 160.

Figure 2:
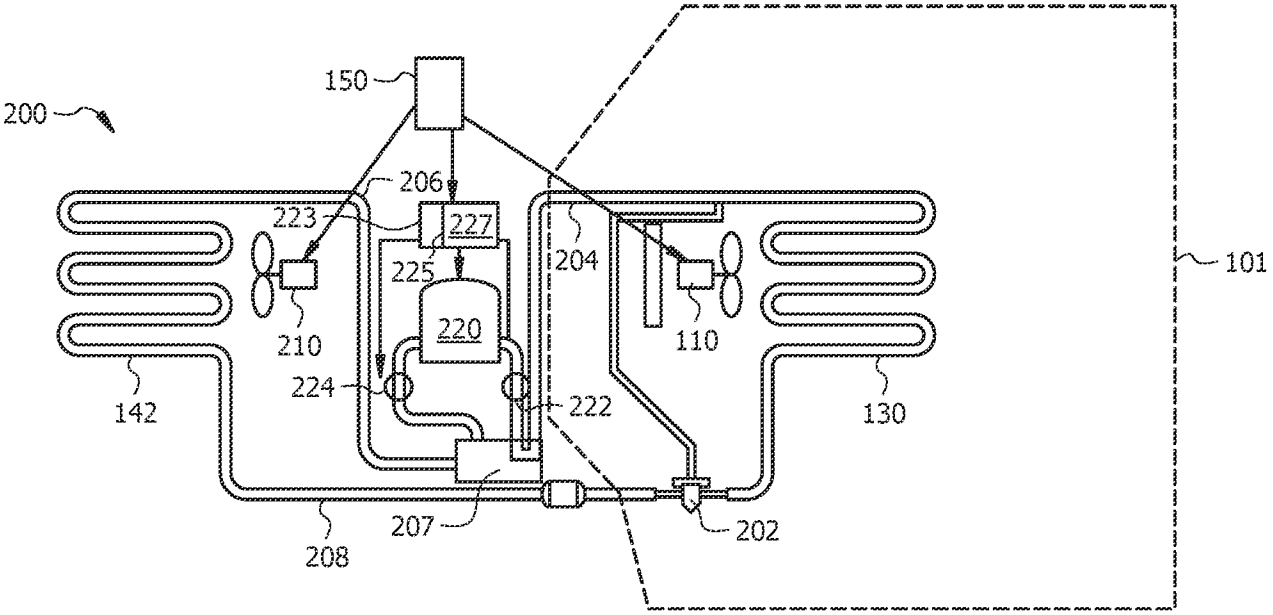
FIG. 2 is a schematic diagram of an HVAC system having a variable speed compressor.

FIG. 2 is a schematic diagram of the HVAC system 200, which has a variable speed compressor 220. For illustrative purposes, FIG. 2 will be described herein relative to FIG. 1. In various embodiments, the HVAC system 200 may operate in heating or air-conditioning mode. The HVAC system 200 includes the indoor heat-exchange coil 130, the outdoor heat-exchange coil 142, a variable speed compressor 220, and a metering device 202. In a typical embodiment, the metering device 202 is, for example, a thermal expansion valve or a throttling valve. The heat-exchange coil 130 is fluidly coupled to the variable speed compressor 220 via a suction line 204. The variable speed compressor 220 is fluidly coupled to the outdoor heat-exchange coil 142 via a discharge line 206. The heat-exchange coil 142 is fluidly coupled to the metering device 202 via a liquid line 208.

During operation, low-pressure, low-temperature refrigerant is circulated through the indoor heat-exchange coil 130. The refrigerant is initially in a liquid/vapor state. In a typical embodiment, the refrigerant is, for example, R-22, R-134a, R-410A, R-744, or any other suitable type of refrigerant as dictated by design requirements. In one or more embodiments, it may alternatively take the form of CO2 or other alternative forms of refrigerant and/or heat-absorbing fluids. The fluids or refrigerant may be in an appropriate thermodynamic state, such as, but not limited to, saturated vapor, saturated liquid, and saturated fluid. A saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refer to a thermodynamic state where a liquid is cooled below the saturation temperature of the liquid.

Returning to FIG. 2, air from within the enclosed space 101 is circulated around the indoor heat-exchange coil 130 by the indoor circulation fan 110. When the HVAC system 200 operates in the air-conditioning mode, the indoor heat-exchange coil 130 functions as an evaporator. Thus, the refrigerant begins to boil after absorbing heat from the air and changes state to a low-pressure, low-temperature, superheated vapor refrigerant. Similarly, when the HVAC system 200 operates in the heating mode, the system functions in reverse, with the indoor heat-exchange coil 130 acting as a condenser coil and the outdoor heat-exchange coil 142 acting as a heat-exchange coil.

The low-pressure, low-temperature, super-heated vapor refrigerant is introduced into the variable speed compressor 220 via the suction line 204. In a typical embodiment, the variable speed compressor 220 increases the pressure of the low-pressure, low-temperature, super-heated vapor refrigerant and, by operation of the ideal gas law, also increases the temperature of the low-pressure, low-temperature, superheated vapor refrigerant to form a high-pressure, high-temperature, superheated vapor refrigerant. The high-pressure, high-temperature, superheated vapor refrigerant leaves the variable speed compressor 220 via the discharge line 206 and is directed to the outdoor heat-exchange coil 142.

In the metering device 202, the pressure of the high-pressure, high-temperature, sub-cooled liquid refrigerant is abruptly reduced. In various embodiments where the metering device 202 is, for example, a thermal expansion valve, the metering device 202 reduces the pressure of the high-pressure, high-temperature, sub-cooled liquid refrigerant by regulating an amount of refrigerant that travels to the indoor heat-exchange coil 130. Abrupt reduction of the pressure of the high-pressure, high-temperature, sub-cooled liquid refrigerant causes sudden, rapid evaporation of a portion of the high-pressure, high-temperature, sub-cooled liquid refrigerant, commonly known as "flash evaporation." The flash evaporation lowers the temperature of the resulting liquid/vapor refrigerant mixture to a temperature lower than that of the air in the enclosed space 101. The liquid/vapor refrigerant mixture leaves the metering device 202 and returns to the indoor heat-exchange coil 130.

An HVAC controller 150 is electrically coupled to the variable speed compressor 220, the indoor circulation fan 110, and the outdoor circulation fan 210. When the HVAC system 200 is operating, the HVAC controller 150 may provide, for example, a 24 VAC signal to the variable speed compressor 220 that primarily causes the variable speed compressor 220 to cycle between an activated state and a de-activated state. In accordance with certain embodiments, this signal may comprise one of two commands that may take the form of a Y1 call and/or a Y2 call. The second command in some embodiments may be a combination of the Y1 call and Y2 call (Y1+Y2). These commands and/or Y calls will be described in more detail below and with regard to the methods of FIG. 3 and FIG. 4.

A compressor controller 223 is electrically coupled to the variable speed compressor 220 and the HVAC controller 150. The compressor controller 223 may include at least one processor 227 and at least one memory 225 that is associated with it. The compressor controller 223 receives the Y calls and operates the variable speed compressor 220 according to the type of Y call or command received. For example, the compressor controller 223 may initially receive a Y1 call which will cause the compressor controller 223 to activate the variable speed compressor 220 and operate it in a first setting (corresponding to the first command), while if a second call Y2 is also received (Y1+Y2 or just Y2) the variable speed compressor is operated in a second setting (corresponding to the second command).

The compressor controller 223 also uses information obtained from a pressure sensor 222. The pressure sensor 222 is disposed in the suction line 204 on the suction side of the variable speed compressor 220 and is electrically coupled to the compressor controller 223. In various embodiments, the pressure sensor 222 is, for example, a pressure transducer. An additional pressure sensor (not shown) that measures discharge or liquid pressure may be placed between the variable speed compressor 220 and the condenser 142 and/or the condenser 142 and the thermal expansion valve and/or metering device 202. A temperature sensor 224 is disposed in the discharge line 206 on the discharge side of the variable speed compressor 220 and is configured to measure a refrigerant temperature in the discharge line 206. According to some embodiments, the pressure sensor 222 and/or temperature sensor 224 provide pressure measurements to the compressor controller 223, which may be used as a proxy for the current load in the enclosed space 101.

During operation, the compressor controller 223 modulates the speed of the variable speed compressor 220 in an effort to optimize the run time of the HVAC system 200. In various embodiments, it is desirable to have the variable speed compressor 220 run as much as possible in an effort to improve thermal comfort in the enclosed space 101 and to reduce energy consumption due to cycling losses. When the HVAC system 200 operates in air-conditioning mode, Outside air is circulated around the outdoor heat-exchange coil 142 by an outdoor circulation fan 210. When the HVAC system 200 operates in air-conditioning mode, the outdoor heat-exchange coil 142 functions as a condenser. Thus, heat is transferred from the high-pressure, high-temperature, superheated vapor refrigerant to the outside air in the air-conditioning mode. Heat removal from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the outdoor heat-exchange coil 142 via the liquid line 208 and enters the metering device 202. As the cooling load in the enclosed space 101 increases, refrigerant pressure in the suction line 204 increases. In various embodiments, the speed of the variable speed compressor 220 is increased in an effort to lower the refrigerant pressure in the suction line 204. Similarly, when the cooling load in the enclosed space 101 decreases, the refrigerant pressure in the suction line 204 decreases. In various embodiments, the speed of the variable speed compressor 220 is decreased in an effort to raise the refrigerant pressure in the suction line 204.

Alternatively, or additionally, when the HVAC system 200 is operating in heating mode, the direction of refrigerant flow is reversed. Thus, in the heating mode, the indoor heat-exchange coil 130 functions as a condenser, and the outdoor heat-exchange coil 142 functions as an evaporator. In various embodiments, the reversal of refrigerant flow is accomplished by a reversing valve 207. As the heating load in the enclosed space 101 increases, the refrigerant temperature in the discharge line 206 decreases. In various embodiments, the speed of the variable speed compressor 220 is increased in an effort to raise the refrigerant temperature in the discharge line 206. Similarly, when the heating load in the enclosed space 101 decreases, the refrigerant temperature in the discharge line 206 increases. In various embodiments, the speed of the variable speed compressor 220 is reduced in an effort to lower the refrigerant temperature in the discharge line 206.

When the signal is the first command (or Y1 call), the variable speed compressor 220 is operated to attempt to keep the measured pressure (such as a suction pressure when the HVAC mode is cooling and liquid pressure when the mode is heating) as measured by the pressure sensor 222 within a predetermined amount of a first pressure set point (such as a first suction pressure set point when the HVAC mode is cooling and a first liquid pressure set point when the mode is heating). This first pressure set point, as well as a second pressure set point, are retrieved from a memory 225 associated with the compressor controller 223 or other controller of the HVAC system 200. Whenever the measured pressure, as measured by the pressure sensor 222, changes, appropriate changes to the compressor speed are made, such as raising or lowering the speed by a predetermined amount. The predetermined amount is determined based on the specific compressor, HVAC system 200, and other considerations of the manufacturer and/or installer of the HVAC system 200.

When the signal is the second command (for example, Y2 call or Y1+Y2 call), the variable speed compressor 220 is operated at a second speed or with a second pressure set point, which may be a threshold speed or threshold pressure that the variable speed compressor 220 may operate, given current environmental and mechanical constraints placed on the variable speed compressor 220. These thresholds may be the threshold amounts (such as, but not limited to, a maximum or minimum) that the variable speed compressor 220 or other components of the HVAC system 200 may operate safely or without significantly shortening their lifetime. This allows the HVAC system 200 to provide sufficient cooling or heating when the air within the enclosed space 101 is outside a comfortable range of a user's desired temperature/humidity. The thresholds may be chosen or determined by the manufacturer or an installer based on the specific components, such as the variable speed compressor 220 that comprises the HVAC system 200. The threshold may also or alternatively be determined by the outside environment and/or indoor environment in which the HVAC system 200 is being deployed. Other methods of determining the threshold may be used without departing from the disclosure.

In various embodiments, the compressor controller 223 may be, for example, a motor control unit, a PID controller, or another appropriate controller. The compressor controller 223 includes a memory 225 associated with the compressor controller 223 and a processor 227. The memory 225 and processor 227 may be part of the compressor controller 223, or one or both may be located in another location. Memory 225 may be any type of storage, and memory 225 may be a non-transitory computer-readable medium in operative communication with the processor 227. The memory 225 may be one or more disks, tape drives, or solid-state drives. Alternatively, or in addition, the memory 225 may be one or more cloud storage devices. The memory 225 may be volatile or non-volatile. It may comprise read-only memory (ROM), random-access memory (RAM), ternary content-addressable memory (TCAM), dynamic random-access memory (DRAM), and static random-access memory (SRAM).

In various embodiments, the processor 227 may be configured to control the variable speed compressor 220 as well as monitor the run time of the variable speed compressor 220. That is, processor 227 measures the length or amount of time that the variable speed compressor 220 is activated as well as the length of time (a first runtime) that the variable-speed compressor 220 operates during a first command (Y1) and the length of time (a second runtime) the variable speed compressor 220 operates during a second command (Y2). The processor 227 is configured to provide a signal to the variable speed compressor 220 to modulate the speed of the variable speed compressor 220.

The processor 227 may take the form of any electronic circuitry including, but not limited to, state machines, one or more central processing unit (CPU) chips, logic units, cores (e.g., a multi-core processor), field-programmable gate array (FPGA), application specific integrated circuits (ASICs), or digital signal processors (DSPs). The processor 227 may be a programmable logic device, a microcontroller, a microprocessor, or any suitable combination of the preceding. The processor 227 is communicatively coupled to and in signal communication with the memory 225. The one or more processors making up the processor 227 are configured to process data and may be implemented in hardware or software. For example, processor 227 may be 8-bit, 16-bit, 32-bit, 64-bit, or any other suitable architecture.

In certain embodiments, once the variable speed compressor 220 finishes running, such as when the signal is removed or a second signal that indicates that the HVAC system 200 should stop is received, or when the command changes from a second command back to a first command (Y1+Y2 to just Y1); the compressor controller 223 analyses the first and second runtimes to determine if the first pressure set point should be adjusted to maintain more efficient and/or better functioning of the HVAC system 200. As will be described in more detail below regarding the method shown in FIG. 4, the first pressure set point is either adjusted up or down to increase the period that the HVAC system 200 operates under the first command (Y1). In a cooling mode, the first pressure set point (first suction pressure set point) is adjusted down and in a heating mode, the pressure set point (first liquid pressure set point) is adjusted up. In certain embodiments, the pressure set point is increased or decreased by an amount that is determined using the following formula:

$$Y1SP = ((Y1RT * AVGP) + (Y2RT * Y2SP))/ART \qquad \text{[Equation 1]}$$

In the equation, Y1SP is the first pressure set point. Y1RT is the first runtime, which is the total length of time the system operates while receiving the first command (Y1). AVGP is the average measured pressure while the system operates while receiving the first command (Y1). Y2RT is the second runtime, which is the period the system operates while receiving the second command (Y2 or Y1+Y2). Y2SP is the second pressure set point used when the second command (Y2 or Y1+Y2) is received and may be either the minimum target suction pressure during cooling or the maximum target liquid pressure during heating. Y2SP is set such that the variable speed compressor 220 operates at or about a threshold compressor speed at a given outdoor temperature. ART is the actual or total runtime of the system and is the sum of the first runtime (Y1RT) and the second runtime (Y2RT, ART=Y1RT+Y2RT). Y1SP and Y2SP are different in a cooling mode than in a heating mode. The disclosure is not limited to the above-described equation, and any formula may be used to determine an appropriate amount to increase or decrease the first pressure set point.

In order to avoid operating the variable speed compressor 220 for shorter periods or longer periods than is ideal for the particular HVAC system 200, one or more embodiments of the disclosure include returning the first pressure set point to a default amount set by the manufacturer, technician, installer, or other party with appropriate abilities and access. As will be described in more detail below regarding the method shown in FIG. 3, the first pressure set point is returned to the default when any of a number of conditions are met.

For example, when the variable speed compressor 220 has been off for a total length of time greater than a first predetermined time, the first pressure set point is returned to the default value. With many HVAC systems 200, it is inefficient or harmful to the components of the HVAC system 200, to not be used periodically. The first predetermined time may be chosen so that the HVAC system avoids being used less than what is desirable. The first predetermined time may also or alternatively be a length of time that previous adjustments, as described above, may no longer be efficient or accurate based on environmental changes that occur in that period as well as and/or other considerations. The first predetermined time period may be, in a non-limiting example, sixty minutes, twelve hours, a day, or any other useful time period chosen by a manufacturer, installer, and/or technician. Other time periods may be used for the first predetermined time without departing from the disclosure.

In another example, if the second runtime is zero and the total runtime is less than a second predetermined time, the first pressure set point is again returned to the default pressure set point. The second predetermined time period is the total time that if the HVAC system 200 operates less than, the HVAC system 200 at least loses some energy efficiency or may be damaged. In a non-limiting example, the second predetermined time may be three minutes. However, any length of time may be used, and the disclosure is not limited to three minutes. The second predetermined time may be determined by a manufacturer, installer, or technician based on the specific components of the HVAC system 200.

In yet another example, if the second runtime is not zero or, the total runtime is less than the second predetermined time, and the second runtime is greater than a third predetermined time, the first pressure set point is also set to a default set point. The third predetermined time may be chosen based on the length of time that it is no longer desirable or efficient to operate the HVAC system 200 under the second command (Y2 call) since during the second command (Y2 call), the system runs at a less efficient threshold level. In a non-limiting example, the third predetermined time period may be fifty-five minutes. However, any length of time may be used, and the disclosure is not limited to fifty-five minutes. The third predetermined time may be determined by a manufacturer, installer, or technician based on the specific components of the HVAC system 200. The first through fourth predetermined times may be any periods of time determined by a manufacturer or installer based on the specific components and operating environment of the variable speed compressor 220, and the above examples are merely examples.

Figure 3:
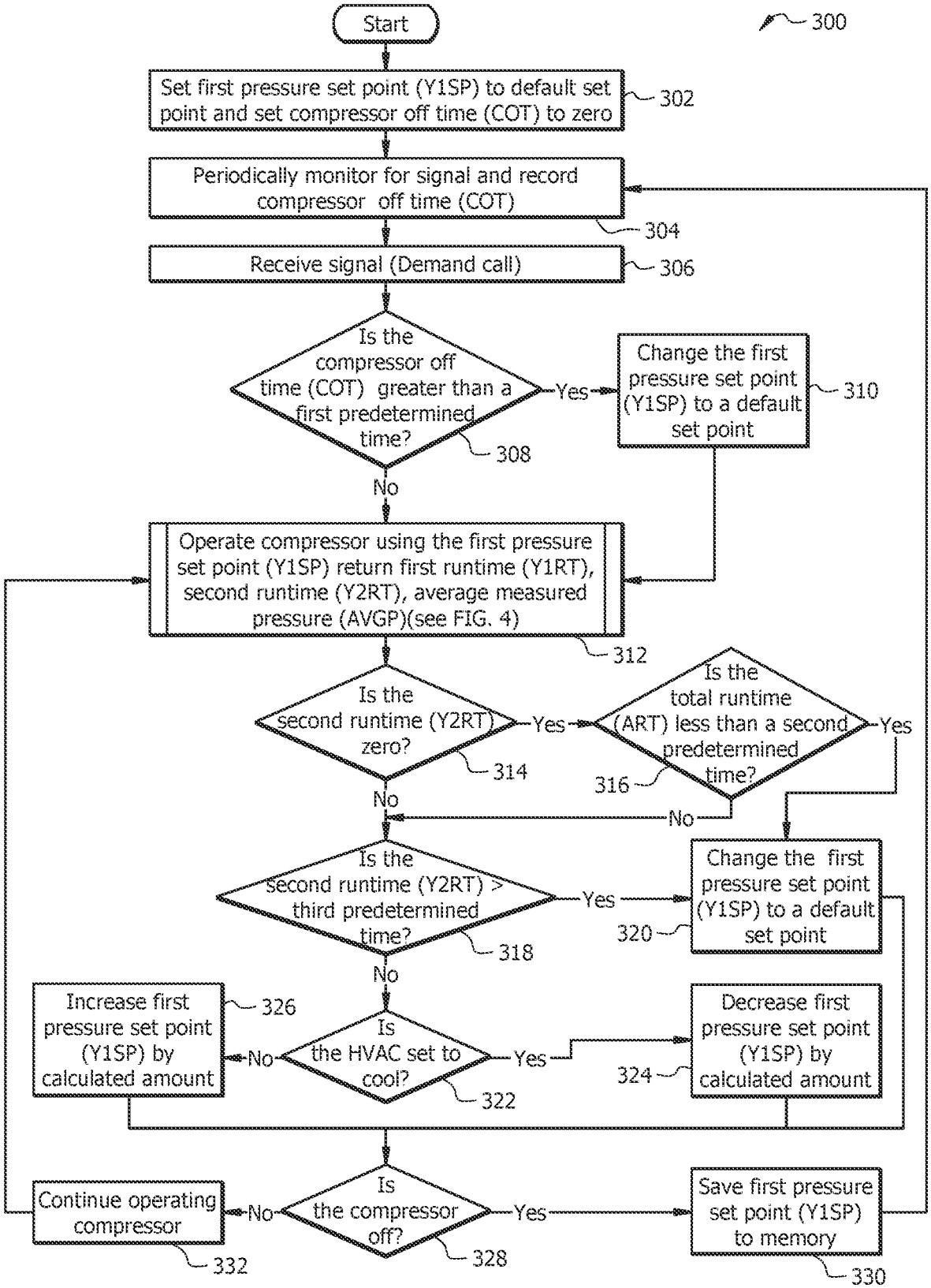
FIG. 3 is a flowchart illustrating a method determining a first pressure set point.

Turning now to FIG. 3, FIG. is a flowchart illustrating a method 300 of determining or setting a first pressure set point (Y1SP). The method may be performed by the HVAC system 200 shown and described above with regards to FIG. 1 and FIG. 2. While the method of FIG. 3 is described as being performed by the HVAC system 200 of FIG. 1 and FIG. 2 and components therein, the method of FIG. 3 may be performed by any suitable HVAC system 200 and is not limited to the one described above with regards to FIG. 1 or FIG. 2.

Method 300 begins in operation 302 by setting the first pressure set point Y1SP to a default set point and setting the compressor off time (COT) to zero. This may be performed after a new HVAC system 200 is initialized for the first time or at any other time when it is desirable to have the HVAC system 200 revert to a default set point. For example, after a system is switched from heating to cooling at the time when the outdoor temperatures begin to rise. Once the first pressure set point (Y1SP) is set to the default set point in operation 302, the HVAC system 200 periodically or continuously monitors for a signal, such as a demand call and records compressor off time (COT) in operation 304.

In operation 306, a signal (demand call) is received. Once the HVAC system 200 receives the signal or demand call in operation 306, the method proceeds to operation 308. In operation 308, a determination is made if the compressor off time (COT) is greater than the first predetermined time. With many HVAC systems 200, it is inefficient or harmful to the components of the HVAC system 200 not to be used periodically. The first predetermined time may be chosen so that the HVAC system avoids being used less than what is desirable. The first predetermined time may also or alternatively be a length of time that previous adjustments, as described above, may no longer be efficient or accurate based on environmental changes that occur in that length of time period and other considerations. In a non-limiting example, the first predetermined time period may be sixty minutes, twelve hours, a day, or any other useful time period chosen by a manufacturer, installer, and/or technician. Other time periods may be used for the first predetermined time without departing from the disclosure.

If in operation 308, it is determined that the compressor off time (COT) is greater than the first predetermined time, the method proceeds to operation 310. In operation 310, the first pressure set point (Y1SP) is changed to the default set point, and the method proceeds to operation 312. If, however, the determination in operation 308 is that the compressor off time (COT) is not greater than the first predetermined time, the method also proceeds to operation 312.

In operation 312, the variable speed compressor 220 and other appropriate components of the HVAC system 200 are activated, and the compressor is operated using the current first pressure set point (Y1SP) as well as the second pressure set point (Y2SP), which are retrieved from a memory 225 associated with the compressor controller 223. The variable speed compressor 220 in certain embodiments may be operated as described in the method of FIG. 4. Alternatively, the variable speed compressor 220 may be operated according to any method without departing from the disclosure. Once a condition is met, such as, for example, when the signal terminates (no Y1) or the command switches from the second command to the first command (Y2 to just Y1), the first runtime (Y1RT), the second runtime (Y2RT), and average measured pressure (AVGP) are returned, and the method precedes to operation 314. The first runtime (Y1RT), the second runtime (Y2RT), and the average measured pressure (AVGP) may be returned at any time, and operations 314-332 may be performed at any time before, during, and/or after the operation of the compressor without departing from the disclosure.

In operation 314, a determination is made by the compressor controller 223 or other component of the HVAC system 200 if the second runtime (Y2RT) is zero. This would occur when the system runs under the first command (Y1) and does not receive the second command (Y2 or Y1+Y2) while the signal (Demand Call or Y1) is present. If the determination is that the second runtime (Y2RT) is zero, the method proceeds to operation 316. Otherwise, the method proceeds to operation 318.

In operation 316, the compressor controller 223 determines if the total runtime (ART=(Y1RT)+(Y2RT)) is less than a second predetermined time period. The second predetermined time period is a period of time determined by a manufacturer or installer to be less than an ideal amount of time for the variable speed compressor 220 and other components of the HVAC system 200 to run. For example, because HVAC systems 200 include various fans, motors, and other electronics that take more energy to start and stop than to operate at a steady state, it is not efficient to start and stop them frequently. The second predetermined time period may be chosen to be the amount of time the HVAC system 200 needs to operate efficiently, or it needs in order to not suffer degradation. In a non-limiting example, the second predetermined time may be three minutes or may be any other time period, such as thirty seconds, one minute, ten minutes, or another time period based on the structure and performance of the HVAC system 200.

If the determination in operation 316 is that the total runtime is less than the second predetermined amount of time, the method proceeds to operation 320, which, similar to that of operation 310, changes the first pressure set point (Y1SP) to a default set point, and proceeds to operation 328. If, however, the determination in operation 316 is that the total runtime is more than the second predetermined amount of time, or if operation 314 is no, the method proceeds to operation 318.

In operation 318, the compressor controller 223 or other component of the HVAC system 200, makes a determination if the second runtime (Y2RT) is greater than a third predetermined period of time. Because while the signal or demand call is the second command (Y2 or Y1+Y2), the variable speed compressor 220 generally runs at a high speed that is at or near a threshold speed for the particular HVAC system 200 or surrounding environment, it is not desirable to operate the variable speed compressor 220 at such a speed and/or second pressure set point (Y2SP) for longer than the third predetermined time period. The third time period may be chosen by a manufacturer, technician, or installer based on the specifics of the variable speed compressor 220, the preferences of the user (for example, if the user does not like hearing the variable speed compressor 220 run for more than fifty-five minutes at full speed), or to avoid damage to the HVAC system 200. Other criteria for selecting the third predetermined time may be used without departing from the disclosure.

If it is determined in operation 318 that the second runtime (Y2RT) is greater than a third predetermined time, the method proceeds to operation 320, which, as described above, resets the first pressure set point (Y1SP) to a default set point. Otherwise, if the second runtime (Y2RT) is not greater than the third predetermined time, the method proceeds to operation 322. In operation 322, a determination is made to determine if the HVAC system 200 is operating as a cooling system or a heating system. If it is operating as a cooling system, the method proceeds to operation 324; however, if the HVAC system is operating as a heating system, the method proceeds to operation 326.

In operations 324 and 326, the first pressure set point (Y1SP) is adjusted either down if operation 324 or up if operation 326. In some embodiments, the adjustment may be determined using Equation 1 discussed above. Once this amount is calculated in either operation 324 or 326, the first pressure set point is adjusted, and the method proceeds to operation 328.

In operation 328, a determination is made if the compressor is off. This may occur when the signal (demand call, Y1) is ended or may occur because of some other reason. If it is determined that the compressor is off the first pressure set point (Y1SP) as determined in one of operations 320, 324, and 326 is saved to a memory, and the method may return to operation 304 and operations 304-332 may be continuously or periodically repeated. Alternatively, after operation 330, the method may end.

If in operation 328, it is determined that the compressor is not off (at least a Y1 signal is being received), the method proceeds to operation 332. In operation 332 the continues to be operated and the method returns to operation 312 and operations 312-328 and operation 332 are repeated until it is determined in operation 328 that the compressor is off.

Method 300 may continue continuously until such time the HVAC system 200 is taken offline for maintenance or other reasons. Modifications, additions, or omissions may be made to method 300 as depicted in FIG. 3. Method 300 may include more, fewer, or other operations. For example, operations may be performed in parallel or in any suitable order. While discussed as HVAC system 200 (or components thereof) performing the operations, any suitable component of HVAC system 200 may perform one or more operations of method 300.

Figure 4:
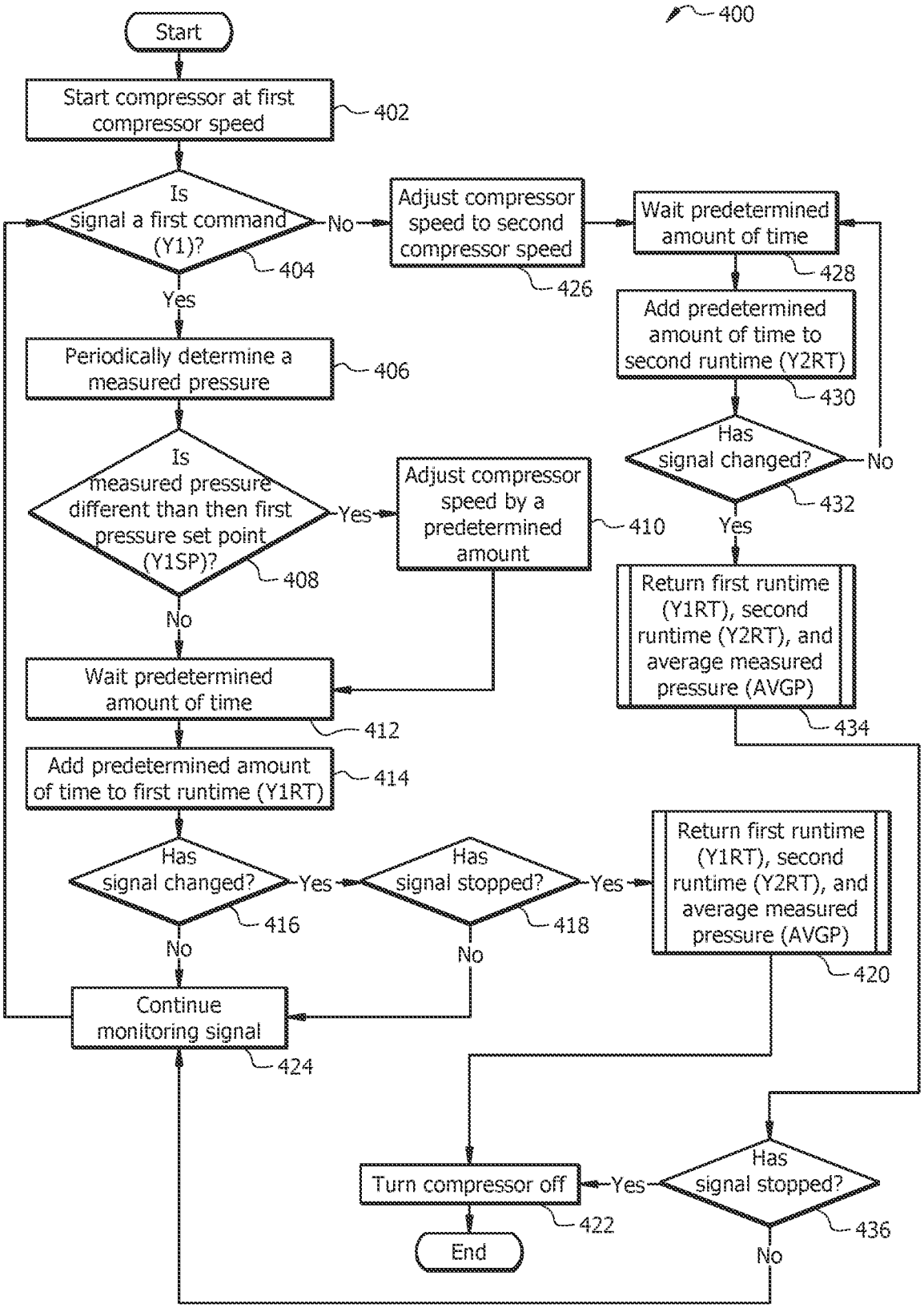
FIG. 4 is a flowchart illustrating a method for operating a compressor.

Turning now to the method shown in FIG. 4, FIG. 4 is a flowchart illustrating method 400 of operating an example HVAC system 200, such as shown and described above with regards to FIG. 1 and FIG. 2. While the method of FIG. 4 is described as being performed by the HVAC system 200 of FIG. 2 and components therein, the method of FIG. 4 may be performed by any suitable HVAC system 200 and is not limited to the one described above with regards to FIG. 1 or FIG. 2. Further, while the method of FIG. 4 is shown as being performed during operation 310 of the method of FIG. 3, the method of FIG. 4 may be performed independently of the method of FIG. 3.

The method 400 of FIG. 4 may begin when the compressor controller 223 or other component of the HVAC system 200 receives a signal, such as a demand call (Y1), as discussed above regarding operations 302-312 in the method shown in FIG. 3. Once the method begins at operation 402, the variable speed compressor 220 is started at the first compressor speed. This first compressor speed may be a default or initial speed that is determined by a manufacturer, installer, or other entity as being a good speed to initially start at due to energy efficiency, average speeds used over a period of time such as days or years, or by other means.

Once the variable speed compressor 220 is started at the first compressor speed in operation 402, the method proceeds to operation 404, where a determination is made if the signal is a first command (Y1) or a second command (Y2). The second command (Y2) may be a completely different signal form the first command and/or demand call, or may be a combination of the signal and a second signal (Y1+Y2). Other combination of signals and calls may be used to indicate a first command or a second command without departing form the disclosure.

If in operation 404 it is determined that signal it is a second command (Y2 or Y1+Y2), the method proceeds to operation 426; however, if it is the first command (Y1), the method proceeds to operation 406, where a measured pressure is periodically determined.

In operation 406, the measured pressure is determined using the pressure sensor 222 to determine suction pressure when the system is operating as a cooling system or a discharge or liquid pressure sensor placed between the compressor and condenser or other location. The pressure may be measured by the pressure sensor 222 or other pressure sensor periodically or continuously. A plurality of its measurements over a set period of time may be averaged to obtain the average measured pressure AVGP. This may be recorded or kept in the memory 225 of the compressor controller 223 for use in later calculations.

Once the measured pressure is determined, the method proceeds to operation 408. In operation 408, the measured pressure determined in operation 406 is compared with the first pressure set point (Y1SP). If the measured pressure is different than the first pressure set point (Y1SP), then the method proceeds to operation 410; however, if the measured pressure is the same as the first pressure set point (Y1SP) or within a predetermined tolerance, for example, one-tenth of a psi, one psi, five psi, or other amounts, the method proceeds to operation 412. In operation 410, the variable speed compressor's 220 speed is adjusted up or down by a predetermined amount to attempt to return the measured pressure to the first pressure set point (Y1SP). The amount of the change in the compressor speed may be related to the difference in the measured pressure from the first pressure set point, or it may be either a predetermined operation up or down. For example, the speed may go up by 10% or down by 10% or other percentages as appropriate, or it may go up or down based on a present amount determined in a table stored in the compressor controller 223.

Once operation 410 is completed or if the measured pressure is the same or within a preset amount of the first pressure set point (Y1SP) in operation 408, the method proceeds to operation 412. In operation 412, the compressor controller 223 or other component of the HVAC system 200 waits a predetermined amount of time, which is added to the first runtime (Y1RT) in operation 414. A manufacturer may determine the predetermined amount of time, which may be based on the speed at which the variable speed compressor 220 may be sped up or sped down or based on the functioning of other components of the HVAC system 200.

Once the predetermined amount of time has been added to the first runtime (Y1RT) in operation 414, the method proceeds to operation 416, where a determination is made if the signal has changed. If the signal has changed, the method proceeds to operation 418, where a determination is made if the signal has stopped or if an alternate signal is received that instructs the operation to stop.

If in operation 418 it is determined that the signal has stopped the method proceeds to operation 420. In operation 420, the first runtime (Y1RT), second runtime (Y2RT), and average measured pressure (AVGP) while operating during the first command (Y1) are returned and may be used as described above in operations 312-332 of FIG. 3 to determine a changed first pressure set point (Y1SP). Once the first runtime (Y1RT), second runtime (Y2RT) and average measured pressure are returned in operation 420, the method proceeds to operation 422, where the compressor is turned off and the method may end.

If in operation 416 is it determined that the signal has not changed or in operation 418 it is determined the signal has not stopped the method proceeds to operation 424. In operation 424, the compressor controller 223 or other components of the HVAC system 200 continues to monitor the signal. The method then returns to operation 404 and repeats operations 404-436 until the signal stops in either operation 418 or as will be described below operation 436.

Returning to operation 404, if the signal is the second command (Y2 or Y1+Y2), the method proceeds to operation 426, where the compressor speed is adjusted to a second compressor speed and/or adjusted to maintain a second pressure set point (Y2SP). In certain embodiments, the second speed is a threshold or predetermined speed that the variable speed compressor 220 may safely operate given current environmental conditions and/or the structure of the variable speed compressor 220 and/or HVAC system 200. Alternatively, the system instead operates the variable speed compressor 220 to try to maintain either a threshold (which may be, but not limited to, a maximum or minimum) second pressure set point (Y2SP). Other speeds or pressures may be used when the signal is the second command (Y2 or Y1+Y2) without departing from the disclosure.

Once the variable speed compressor's 220 speed is adjusted, the method waits a predetermined amount of time in operation 428. This predetermined amount of time may be the same as the predetermined amount of time waited in operation 412, or it may differ depending on the specific configuration of the HVAC system 200. The predetermined amount of time that the variable speed compressor 220 operates during a second command (Y2 or Y1+Y2) is added to the second runtime (Y2RT) in operation 430, and the method proceeds to operation 432.

In operation 432 a determination is made if the signal(s) (demand call having Y2 or both Y1 and Y2) has changed for example Y2 stops or both Y1 and Y2 stop. If it has not, the method returns to operation 428 and operation 428-432 continue to be performed until the signal(s) is determined to have changed in operation 432. When a determination is made in operation 432 that the signal has changed (at least Y2 stops), the method proceeds to operation 434.

In operation 434 the first runtime (Y1RT), second runtime (Y2RT), and average measured pressure (AVGP) while operating during the first command (Y1) are returned and may be used as described above in operations 312-332 of FIG. 3 to determine a changed first pressure set point (Y1SP). Once the first runtime (Y1RT), second runtime (Y2RT) and average measured pressure are returned in operation 434, the method proceeds to operation 436, where a determination is made if the signal has stopped (both Y1 and Y2 have stopped). If in operation 436 it is determined that the signal has stopped the method proceeds to operation 422 where, as described above, the compressor is runed off and the method may end. If in operation 436 it is alternatively determined that the signal has not stopped (Y1 is still present), the method proceeds to operation 424 and operations 404-436 are repeated until the signal is determined to have stopped in either operation 418 or in operation 436 and the method end after operation 422.

Modifications, additions, or omissions may be made to method 400, depicted in FIG. 4. Method 400 may include more, fewer, or other operations. For example, the operations may be performed in parallel or in any suitable order. While discussed as HVAC system 200 (or components thereof) performing the operations, any suitable component of HVAC system 200 may perform one or more operations of method 400.

Modifications, additions, or omissions may be made to any of the methods disclosed herein. These methods may include more, fewer, or other operations, and operations may be performed in parallel or in any suitable order. Throughout the disclosure, the term HVAC is used in a general sense and refers to any system that circulates refrigerant to control the temperature of a conditioned space. Examples include heat pump systems, air conditioning systems, combined heating and air conditioning systems, and refrigeration systems. Similarly, the term refrigerant is used in a general sense and refers to any medium that facilitates heat transfer in an HVAC system. Examples include natural refrigerants, such as carbon dioxide, ammonia, water, air, conventional refrigerants, or coolants.

While discussed as certain components of the HVAC system controller 150 or compressor controller 223 performing the operations, any suitable component or combination of components may perform one or more operations of these methods. Specific examples have been described using the modifiers "first," "second," or "third" (e.g., first sensor data, second sensor data, third sensor data; first action, second action). Unless the context in which these modifiers appear indicates otherwise, the modifiers do not require any particular sequence of operations or arrangement of devices.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A method comprising:

receiving a signal and determining a compressor off time;

retrieving a first pressure set point and a second pressure set point from a memory of a device connected to the compressor, wherein the first pressure set point is changed to a default set point when the compressor off time is greater than a first predetermined time;

operating a compressor at a compressor speed that is determined based on at least one of the first pressure set point or the second pressure set point while the signal is received, wherein the compressor speed is determined by the first pressure set point when the signal is a first command and the compressor speed is determined by the second pressure set point when the signal is a second command;

determining a first runtime, a second runtime, and a total runtime, wherein:

the first runtime is a length of time the signal is a first command, the second runtime is a length of time the signal is a second command, and the total runtime is a sum of the first runtime and the second runtime;

changing the first pressure set point to a default set point when at least one condition is met;

changing the first pressure set point by an amount that is determined using at least one of the first runtime, the second runtime, the total runtime, and an average measured pressure when the at least one condition is not met; and storing the first changed pressure set point in the memory of the device.

2. The method of claim 1, wherein the at least one condition is met when the second runtime is zero and the total runtime is less than a second predetermined time.

3. The method of claim 1, wherein the at least one condition is met when the second runtime is not zero and the second runtime is greater than a third predetermined time.

4. The method of claim 1, wherein operating the compressor comprises:

determining periodically if the signal is the first command or the second command;

determining periodically a measured pressure in a suction line between the compressor and an indoor heat-exchange coil; and adjusting a compressor speed periodically to an adjusted compressor speed when the measured pressure is different by a predetermined amount from the first pressure set point while the signal is the first command or from the second pressure set point while the signal is the second command.

5. The method of claim 1, wherein the compressor is part of a heating, ventilation, and air-conditioning (HVAC) system, and when the HVAC system is operating as a cooling system, the first pressure set point is changed by decreasing the first pressure set point by the amount.

6. The method of claim 1, wherein the compressor is part of a heating, ventilation, and air-conditioning (HVAC) system, and when the HVAC system is operating as a heating system, the first pressure set point is changed by increasing the first pressure set point by the amount.

7. The method of claim 1, wherein the amount is calculated using a formula:

$$Y1SP = ((Y1RT * AVGSPY1) + (Y2RT * Y2SP))/ART;$$

wherein Y1SP is the first pressure set point, Y1RT is the first runtime, Y2RT is the second runtime, AVGSPY1 is the average measured pressure during the first command, Y2SP is the second pressure set point, and ART is the total runtime.

8. A compressor controller electrically coupled to a compressor of a heating, ventilation, and air-conditioning (HVAC) system, the compressor controller configured to:

receive a signal;

determine a compressor off time;

retrieve a first pressure set point and a second pressure set point from memory associated with the compressor controller, wherein the first pressure set point is changed to a default set point when the compressor off time is greater than a first predetermined time;

operate a compressor at a compressor speed that is determined based on at least one of the first pressure set point or the second pressure set point while the signal is received, wherein the compressor speed is determined by the first pressure set point when the signal is a first command and the compressor speed is determined by the second pressure set point when the signal is a second command;

determine a first runtime, a second runtime, and a total runtime, wherein:

the first runtime is a length of time the signal is a first command, the second runtime is a length of time the signal is a second command, and the total runtime is a sum of the first runtime and the second runtime;

changing the first pressure set point to a default set point when at least one condition is met;

changing the first pressure set point by an amount that is determined using at least one of the first runtime, the second runtime, the total runtime, and an average measured pressure when the at least one condition is not met; and storing the changed first pressure set point in the memory.

9. The compressor controller of claim 8, wherein the at least one condition is met when the second runtime is zero and the total runtime is less than a second predetermined time.

10. The compressor controller of claim 8, wherein the at least one condition is met when the second runtime is not zero and the second runtime is greater than a third predetermined time.

11. The compressor controller of claim 9, wherein operating the compressor comprises:

determining periodically if the signal is the first command or the second command;

determining periodically a measured pressure in a suction line between the compressor and an indoor heat-exchange coil; and adjusting a compressor speed periodically to an adjusted compressor speed when the measured pressure is different by a predetermined amount from the first pressure set point while the signal is the first command or from the second pressure set point while the signal is the second command.

12. The compressor controller of claim 9, wherein when the HVAC system, and when the HVAC system is operating as a cooling system, the first pressure set point is changed by decreasing the first pressure set point by the amount.

13. The compressor controller of claim 9, wherein when the HVAC system, and when the HVAC system is operating as a heating system, the first pressure set point is changed by increasing the first pressure set point by the amount.

14. The compressor controller of claim 9, wherein the amount is calculated by the compressor controller using a formula:

$$Y1SP = ((Y1RT * AVGSPY1) + (Y2RT * Y2SP))/ART;$$

wherein Y1SP is the first pressure set point, Y1RT is the first runtime, Y2RT is the second runtime, AVGSPY1 is the average measured pressure during the first command, Y2SP is the second pressure set point, and ART is the total runtime.

15. A heating, ventilation, and air-conditioning (HVAC) system comprising:

an indoor unit that comprises:

an indoor heat-exchange coil;

an indoor circulation fan arranged to circulate air through the indoor heat-exchange coil; and a metering device fluidly coupled to the indoor heat-exchange coil;

an outdoor unit comprising:

an outdoor heat-exchange coil;

an outdoor circulation fan arranged to circulate air through the outdoor heat-exchange coil;

a compressor fluidly coupled to the outdoor heat-exchange coil and fluidly coupled to the indoor heat-exchange coil; and a compressor controller electrically coupled to the compressor, wherein the compressor controller comprises at least one processor and at least one memory associated with the compressor controller;

a pressure sensor electrically coupled to the compressor controller; and an HVAC controller electrically coupled to the compressor controller, the HVAC controller configured to send a signal to the compressor controller;

wherein the compressor controller is configured to:

receive the signal;

determine a compressor off time;

retrieve a first pressure set point and a second pressure set point from the at least one memory, wherein the first pressure set point is changed to a default set point when the compressor off time is greater than a first predetermined time;

operate the compressor at a compressor speed that is determined based on at least one of the first pressure set point or the second pressure set point while the signal is received, wherein the compressor speed is determined by the first pressure set point when the signal is a first command and the compressor speed is determined by the second pressure set point when the signal is a second command;

determine a first runtime, a second runtime, and a total runtime, wherein:

the first runtime is a length of time the signal is a first command, the second runtime is a length of time the signal is a second command, and the total runtime is a sum of the first runtime and the second runtime;

changing the first pressure set point to a default set point when at least one condition is met;

changing the first pressure set point by an amount that is determined using at least one of the first runtime, the second runtime, the total runtime, and an average measured pressure when the at least one condition is not met; and storing the changed first pressure set point in the at least one memory.

16. The HVAC system of claim 15, wherein the at least one condition is met when the second runtime is zero and the total runtime is less than a second predetermined time.

17. The HVAC system of claim 15, wherein the at least one condition is met when the second runtime is not zero and the second runtime is greater than a third predetermined time.

18. The HVAC system of claim 15, wherein operating the compressor comprises:

determining periodically if the signal is the first command or the second command;

determining periodically a measured pressure in a suction line between the compressor and an indoor heat-exchange coil; and adjusting a compressor speed periodically to an adjusted compressor speed when the measured pressure is different by a predetermined amount from the first pressure set point while the signal is the first command or from the second pressure set point while the signal is the second command.

19. The HVAC system of claim 15, wherein when the HVAC system, and when the HVAC system is operating as a cooling system, the first pressure set point is changed by decreasing the first pressure set point by the amount.

20. The HVAC system of claim 15, wherein when the HVAC system, and when the HVAC system is operating as a heating system, the first pressure set point is changed by increasing the first pressure set point by the amount.

* * * * *